US005484199A

United States Patent [19]

Gasser et al.

[11] Patent Number: 5,484,199

[45] Date of Patent: Jan. 16, 1996

[54] GUIDE RAIL ASSEMBLY FOR DRAWERS

[75] Inventors: Ingo Gasser, Höchst; Hermann Hämmerle, Lustenau, both of Austria

[73] Assignee: Julius Blum Gesellschaft m.b.H., Höchst, Austria

[21] Appl. No.: 372,375

[22] Filed: Jan. 13, 1995

[30] Foreign Application Priority Data

Jan. 17, 1994 [AT] Austria ..... A67/94

[51] Int. Cl.[6] ..... A47B 88/10

[52] U.S. Cl. ..... 312/334.33; 312/334.9

[58] Field of Search ..... 312/334.33, 334.9, 312/334.12, 334.21, 334.42; 384/19

[56] References Cited

U.S. PATENT DOCUMENTS 3,722,964 3/1973 Chitester et al. ..... 312/334.9 X 4,025,138 5/1977 Kittle ..... 312/334

*Primary Examiner*—Jose V. Chen
*Assistant Examiner*—Rodney B. White
*Attorney, Agent, or Firm*—Wenderoth, Lind & Ponack

[57] ABSTRACT

A guide rail assembly for use on each of opposite sides of a drawer includes a support rail fastenable to a furniture body, a pull-out rail fastenable to the drawer and a middle rail disposed between the support rail and the pull-out rail. The weight of the drawer is transmitted between the rails by means of track or guide rollers. Respective deflection rollers or pulleys for a control rope are disposed at front and rear ends of the middle rail. Disposed at the front end of the middle rail is an end bearer or guide member made of plastic material and having at a front end thereof a curved, downwardly directed cap for the front end of the middle rail.

3 Claims, 3 Drawing Sheets

GUIDE RAIL ASSEMBLY FOR DRAWERS

FIELD AND BACKGROUND OF THE INVENTION

The invention relates to a guide rail assembly for use on each of opposite sides of a drawer, and including a support rail fastenable to a furniture carcass or body, a pull-out rail fastenable to the drawer and a middle rail disposed between the support rail and the pull-out rail, the weight of the drawer being transmitted between the rails by means of track or guide rollers. Respective deflection rollers or pulleys preferably are disposed at front and rear ends of the middle rail, and a control rope or cable is fastened to the support rail and to the pull-out rail and is guided over the deflection roller. An end bearer or guide member is disposed at the front end of the middle rail.

Various guide rail assemblies for drawers are known, which enable the entire drawer to be pulled from the furniture carcass or body and yet still be supported by the rails of the assemblies. In some cases, a device is provided which is meant to ensure that the rails operate differentially in relation to one another. Such device may include, for example, a gear wheel which is mounted on the middle rail and meshes with toothed racks on the pull-out rail and the support rail. A simplified construction would be the arrangement of a friction wheel on the middle rail.

High precision guidance of the middle rail is achieved by means of a control rope or cable that is fastened to the support rail and the pull-out rail, that extends on both sides of the middle rail and that at the front and rear ends is guided over belt guides of the middle rail. Such a differential guide rail assembly is described in DE-A1-29 04 116. A guide rail assembly wherein a control rope or cable is guided over rollers is disclosed in U.S. Pat. No. 4,025,138.

SUMMARY OF THE INVENTION

The object of the invention is to provide an improved pull-out guide rail assembly of the aforementioned type, whereby reinsertion of a drawer which has been fully withdrawn from the furniture body is facilitated.

According to the invention, such object is achieved in that an end bearer or guide member has at a front thereof a curved, downwardly directed cap for the front end of the middle rail, as well as a rail web which extends in a longitudinal direction and has a straight portion and a front, bent-down portion. Provided in the region of the rail web is an opening in which is supported a guide or track roller associated with the middle rail.

The end bearer according to the invention facilitates coupling of the pull-out rail with the middle rail and at the same time offers protection to the guide roller for the control rope which is disposed at the front end of the middle rail. Insertion of the pull-out rail into the guide rail assembly is facilitated particularly by rail webs disposed in front of and behind the guide or track roller.

DESCRIPTION OF THE PREFERRED EMBODIMENT

Figure 1:
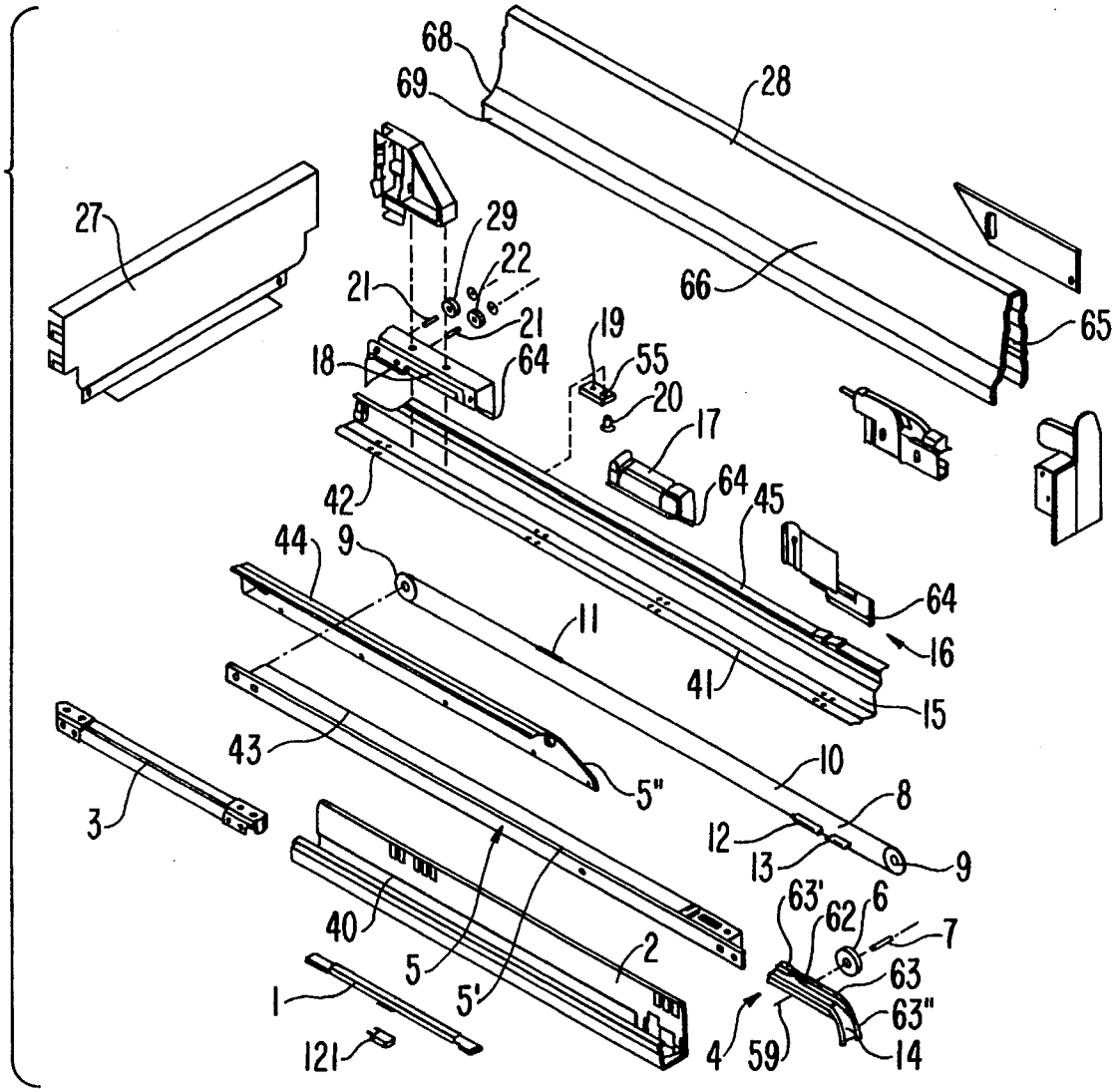
FIG. 1 is an exploded perspective view of the parts of a guide rail assembly, including one embodiment of a cap, and a drawer frame.
Figure 2:
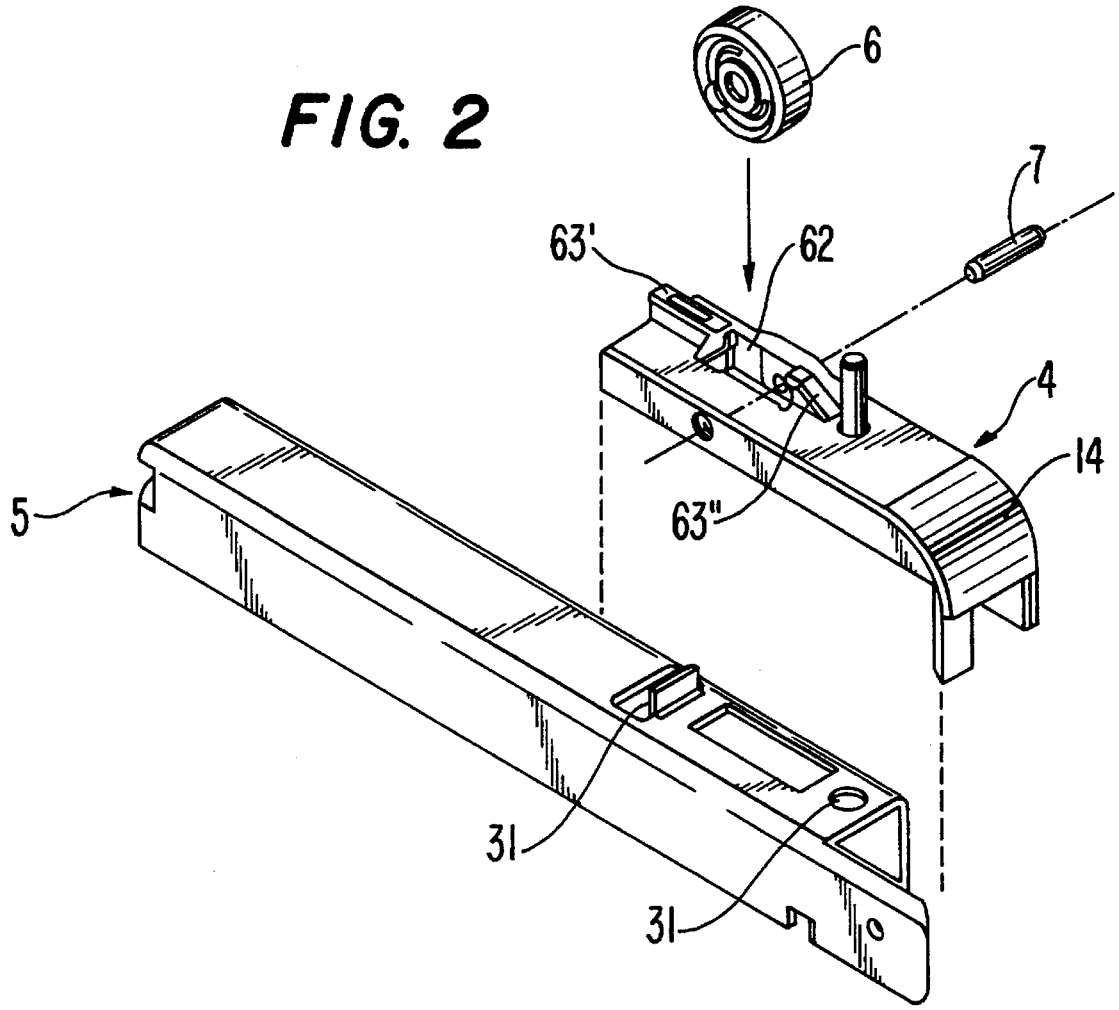
FIG. 2 is an exploded perspective view of a front end of a middle rail and another embodiment of a cap.
Figure 3:
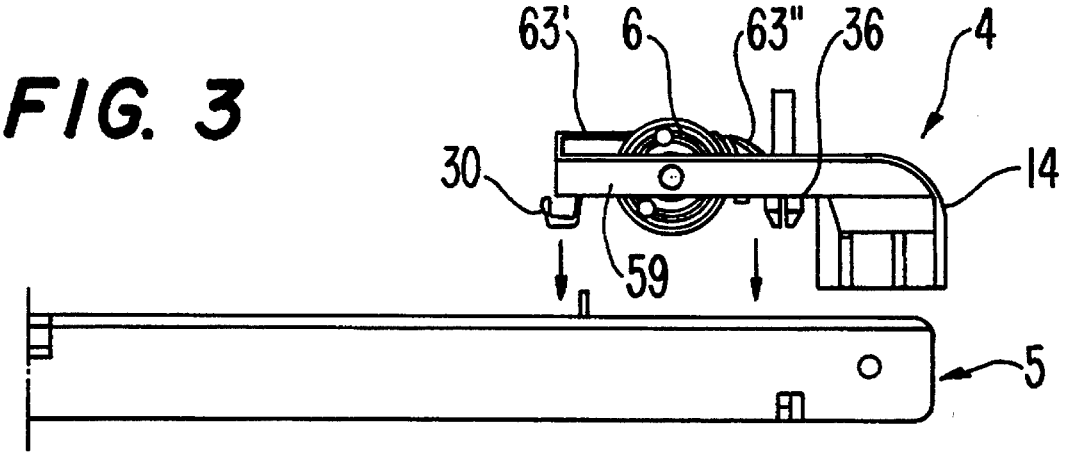
FIG. 3 is a side view of the middle rail and the cap of FIG. 2 prior to assembly.
Figure 4:
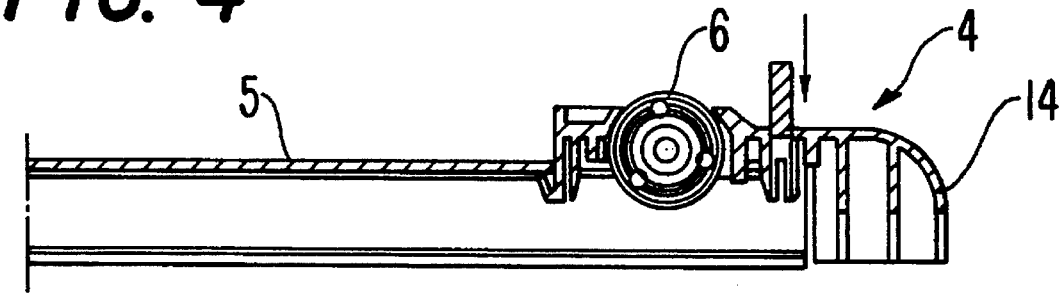
FIG. 4 is a sectional view thereof through the middle rail and the cap upon mounting thereof.
Figure 5:
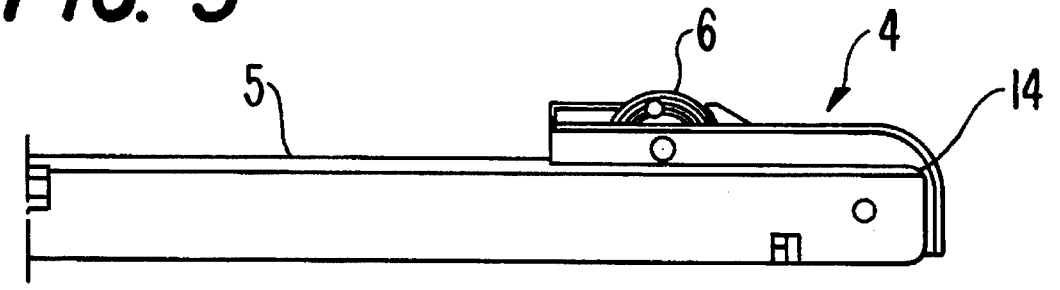
FIG. 5 is a side view thereof of the middle rail with the cap mounted.

A drawer is formed by two metal side walls or drawer frames 28, a front panel, a bottom plate and a back wall 27. Situated inside each drawer frame 28 are three fitting pieces 16, 17, 18 which are fastened, e.g. welded, to a pull-out rail 15. A support rail 2 is to be fastened in a conventional manner by a fastening web 40 thereof to a side wall of a cabinet. The drawer base rests on a horizontal web 41 of the pull-out rail 15. Situated in the horizontal web 41 are tenon-shaped tabs 42, which may be pressed out of the horizontal web 41 and into a groove or the like of the drawer base, e.g. a bottom plate, thereby anchoring the drawer on the pull-out rail 15.

A middle or intermediate rail 5 is situated between the pull-out rail 15 and the support rail 2. The middle rail 5 has a bottom profile or profile member 5', situated in which is a carriage 3, in which are supported guide or track rollers. The middle rail 5 therefore is guided relative to the support rail 2 by means of the track rollers supported in the carriage 3. The middle rail 5 is further provided with a top, partially U-shaped profile or profile member 5". Track or guide rollers 22, 29 supported on the rear fitting piece 18 of the pull-out rail 15 run along running webs 43, 44 of profiles 5', 5". Running web 45 of the pull-out rail 15 in turn runs along track or guide roller 6 supported on the bottom profile 5' of the middle rail 5.

The middle rail 5 has front and rear pulleys 9 for a control rope or cable 10 which, in the form of a continuous belt, is supported by such pulleys 9 on the middle rail 5. The control rope 10, which is formed, for example, by a wire or plastic rope, has a snap-action rope coupling 8 including two coupling parts 12, 13 which are connected to the ends of the control rope 10. The coupling part 13 is anchored by means of a hook to the support rail 2. The control rope 10 is connected to the pull-out rail 15 by a further coupling including an outer coupling member 19 and an inner coupling member 11. The outer coupling member 19 is fastened to the pull-out rail 15 by means of screws or rivets 20 that project through fastening holes. The outer coupling member 19 embraces the inner coupling member 11 in a pincer-like manner. The inner coupling member 11 may be pressed into a trough-like recess 55 of the outer coupling member 19.

Roller 6 is supported at the front end of the bottom profile 5' of the middle rail 5 by means of a rivet 7 on lugs 59 of an end bearer or guide member 4. The running web 45 of the pull-out rail 15 runs along on the track roller 6. The two rollers 22, 29 are mounted by means of rivets 21 on the rearmost fitting piece 18. Such rollers are guided in the top profile 5" of the middle rail 5 and are situated inside the fitting piece 18. They effect a successive supporting action. The front roller 22 is narrower than the rear roller 29 and is supported, during displacement of the drawer, on the web 43 of the top profile 5" of the middle rail 5. Since the roller 22 is supported on the bottom horizontal web 43 and the roller 29 is supported on the top horizontal web 44, when the drawer is pulled out or pushed in there is no change in the direction of rotation of the rollers 22, 29. Thus, the drawer is guided smoothly.

End bearer or guide member 4, made of plastic material, is fastened at the front end of the bottom profile 5' of the middle rail 5. The end bearer or guide member 4 has an opening 62 through which projects the roller 6. The end bearer or guide member 4, which overlaps and with a curved cap 14 at least partially covers the front end of the bottom profile 5' of the middle rail 5 is provided with a rail web 63 having a straight portion 63' and a front, bent-down portion 63". The end bearer or guide member 4 has pins 30, 36 that are insertable into punched holes 31 of the middle rail 5 and by means of which the end bearer or guide member 4 may be fitted onto the middle rail 5. The rivet 7 inserted into lugs 59 of end bearer or guide member 4 serves as a bearing axle for the roller 6, with roller 6 projecting into recess or opening 62 in the end bearer or guide member 4. When the drawer is inserted, each pull-out rail 15 is guided with running web 45 thereof on the rail web 63 of the end bearer or guide member 4, thereby substantially facilitating insertion of the drawer into the guide rail assembly.

All three fitting pieces 16, 17, 18 have downwardly projecting retaining webs 64. Each drawer frame 28 is of a double-walled construction, having an outer wall 65 and an inner wall 66. At its bottom edge the outer wall 65 has a retaining web, bent inwards and upwards in the manner of a hook, by means of which the outer wall may be hung in the retaining webs 64 of the fitting pieces 16, 17, 18. The inner wall 66 has a horizontal web 68, which once the drawer is assembled rests on the drawer base, and a vertical lateral web 69 which lies laterally adjacent to the drawer base. The transition from the horizontal web 68 to the inner wall 66 is rounded off.

Since the drawer frame 28 is welded neither to the fitting pieces 16, 17, 18 nor to the pull-out rail 15, drawer frames made of any material, ranging from plastic and aluminum frames to frame made of stainless steel, may be hung in the fitting pieces 16, 17, 18. The furniture manufacturer is therefore offered the possibility of equipping drawers of widely differing price with the differential pull-out device according to the invention.

A pull-in device 1 for the drawer is mounted on the support rail 2. Such device includes a spring-loaded tilting segment 121, which serves as a driver for a pin disposed on the middle rail 5.

We claim:

1. A guide rail assembly for use on each of opposite sides of a drawer to guide movement of the drawer into and out of an article of furniture, said assembly comprising:

a supporting rail to be attached to a furniture side wall;

a pull-out rail to be attached to the drawer;

an intermediate rail between said supporting rail and said pull-out rail;

respective pulleys mounted on front and rear ends of said intermediate rail;

a cable running on said two pulleys and fastened to said supporting rail and to said pull-out rail;

a guide member mounted on a front portion of said intermediate rail, said guide member having a downwardly directed cap covering a front end of said intermediate rail, a longitudinal rail web including a rectilinear portion and a front, bent-down portion, and an opening adjacent said rail web; and a guide roller supported within said opening of said guide member.

2. An assembly as claimed in claim 1, wherein said guide member further includes two upwardly extending lugs, and an axle supported in said lugs and carrying said guide roller.

3. An assembly as claimed in claim 1, wherein said guide member is formed of a plastic material.

* * * * *